United States Patent [19]

Yanusko et al.

[11] Patent Number: 4,881,447

[45] Date of Patent: Nov. 21, 1989

[54] ROUND-ORIENTING REPLENISHER FOR AMMUNITION STORAGE AND TRANSPORT SYSTEM

[75] Inventors: David P. Yanusko, Pottstown; Robert Geiger, Jr., Geigertown, both of Pa.

[73] Assignee: Teleflex Incorporated, King of Prussia, Pa.

[21] Appl. No.: 200,010

[22] Filed: May 27, 1988

[51] Int. Cl.[4] ..... F41F 9/02; F42B 39/10; F42B 39/12

[52] U.S. Cl. ..... 89/34; 86/48; 89/33.1; 89/33.16

[58] Field of Search ..... 89/34, 33.1, 33.14, 89/33.16, 33.17; 86/47, 48

[56] References Cited

U.S. PATENT DOCUMENTS

| | | | |
|---|---|---|---|
| 2,541,530 | 2/1951 | Meyer | 89/33.17 |
| 3,696,704 | 10/1972 | Backus et al. | 89/34 |
| 4,004,490 | 1/1977 | Dix et al. | 89/34 |
| 4,005,633 | 2/1977 | Kirkpatrick | 89/33.04 |
| 4,137,820 | 2/1979 | Clemens | 89/34 |
| 4,292,878 | 10/1981 | Brooks et al. | 86/48 |
| 4,509,401 | 4/1985 | Pollock | 86/48 |
| 4,566,580 | 1/1986 | Aloi et al. | 89/33.14 |
| 4,572,351 | 2/1986 | Golden | 89/33.16 |

*Primary Examiner*—David H. Brown
*Attorney, Agent, or Firm*—Steele, Gould & Fried

[57] ABSTRACT

A replenisher for an ammunition storage drum has a housing with a main sprocket assembly rotatably disposed therein, with receptacles around a periphery for individual rounds of ammunition. At least one inlet accepts separate (linkless) rounds and places them in the receptacles. The inlet includes a hopper for loose rounds oriented in either of two opposite directions, which rounds are separated by orientation using wire guides engaging extractor flanges of the rounds and feeding the rounds. Converging helices re-entrain the rounds in single file, leading to a feed gear and sprocket assembly engaging the main sprocket assembly. At least one outlet from the main sprocket assembly has an external configuration dimensioned to receive an interface adapter which also mates with a gun magazine. The ammunition storage drum interchangeably connects by means of a power-transmitting conveyor to the replenisher or to the gun magazine. The replenisher conveys live rounds to the ammunition storage drum and accepts spent rounds including unfired rounds and empty cartridge casings. The storage drum conveys live rounds to the aircraft while accepting spent rounds therefrom.

20 Claims, 3 Drawing Sheets

FIG.1
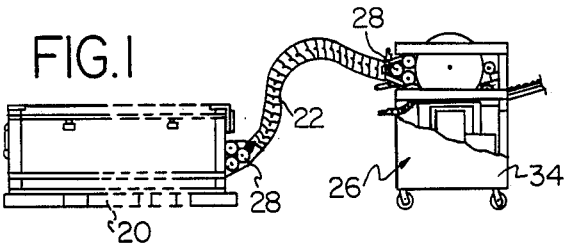
FIG.2
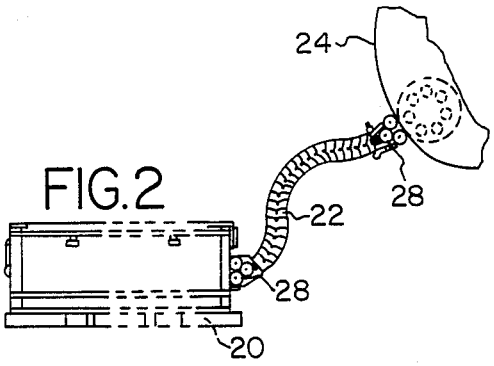
FIG.5
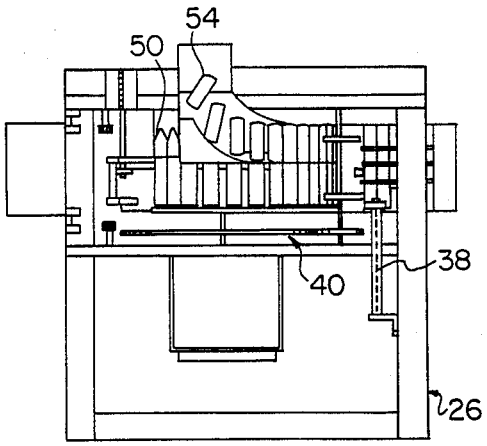
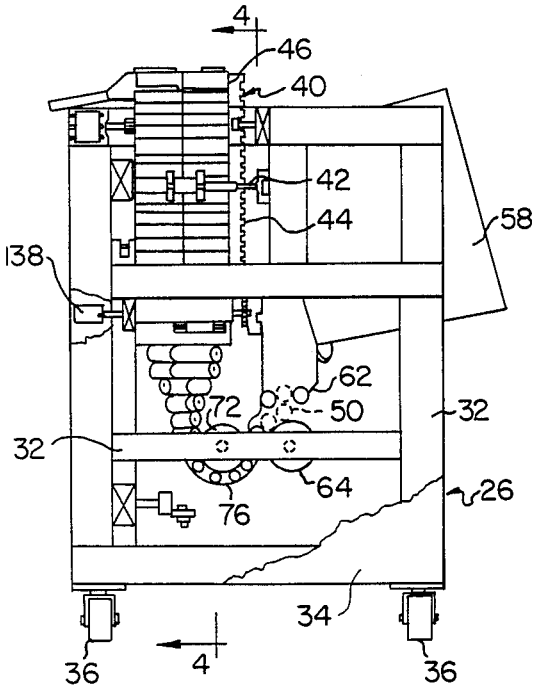
FIG.3
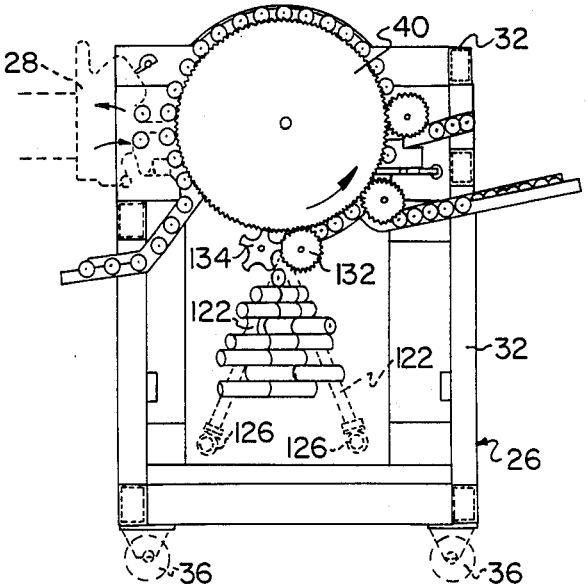
FIG.4

ROUND-ORIENTING REPLENISHER FOR AMMUNITION STORAGE AND TRANSPORT SYSTEM

BACKGROUND OF THE INVENTION

1. Field of the Invention

This invention relates to feeding and storage of linkless ammunition by means of a storage drum which connects either to a gun magazine or to a replenisher. The replenisher accepts input rounds from a plurality of sources, orienting and entraining the rounds along a conveyor leading to the storage drum. The replenisher likewise accepts and sorts returning rounds, including unfired rounds, live rounds and empty cartridge casings.

2. Prior Art

For feeding rounds to high rate of fire guns, it is known to employ a linkless ammunition carrying arrangement, including a storage drum in which a large number of rounds are stored, means connecting the storage drum to a gun magazine such as in an aircraft, and a conveyor for carrying the rounds in a loop whereby the contents of the storage drum are moved into the gun magazine and the contents of the gun magazine are returned to the storage drum. The linkless rounds conveyed may include live rounds and/or spent rounds, the latter being either or both of unfired live rounds and empty cartridge casings. An example of an ammunition storage drum and conveyor for attaching the ammunition storage drum to a gun magazine are shown in U.S. Pat. Nos. 3,696,704-Backus et al; 4,004,490-Dix et al; and, 4,005,633-Kirkpatrick.

According to U.S. Pat. No. 4,292,878-Brooks et al, the storage drums of the aforesaid system can be replenished with bulk packaged ammunition, of the type in which each round is alternately oriented to achieve maximum packing density in view of the tapering shape of the rounds (i.e., wider at the base). In the Brooks patent, means are provided for re-orienting the rounds all in the same direction. Rounds are conveyed along a direction perpendicular to their longitudinal axes, each round being horizontal and oriented in one direction or the other. Because the center of gravity of the rounds is nearer the nose than the base, the rounds fall one way or the other as a function of their orientation and are thereby sorted. Another example of such a means for re-orienting ammunition is disclosed in U.S. Pat. No. 4,566,580Aloi et al, which uses a similar unbalanced process for re-orienting the rounds based upon their center of gravity. Aloi also teaches using such a device to interleave rounds of different types, for example armor piercing, tracer, etc.

The disclosures of the foregoing patents are hereby incorporated.

In relying upon the center of gravity of a round being slightly further towards one end or the other, the prior art re-orienting devices require that the rounds be accurately positioned at the balancing point. It is also helpful if the rounds are moving relatively slowly at the balancing point, or, alternatively, the balancing rail can extend along a substantial linear distance along the path of conveyance. In the present invention, mechanical means are provided positively but selectively to engage the rounds for re-orienting them. This permits a very high speed and very dependable operation, without relying upon balancing the rounds to determine their orientation.

According to the present invention, a replenishing device is provided with externally exposed gear and sprocket configurations similar to those of a gun magazine, whereby the same conveyor mechanism that would connect an ammunition storage drum to the gun magazine can also connect the ammunition storage drum to the replenishing device. This permits the replenisher and ammunition storage drum to be operated synchronously in the same manner that the storage drum and gun magazine are operated synchronously in reloading the gun magazine. Accordingly, the overall process of storing, transporting, reloading and sorting rounds becomes a matter of connecting modular components as required.

According to the present invention, a plurality of different inlets for rounds can be provided around the periphery of a main sprocket assembly, at least one of the inlets including a means for receiving bulk rounds simply poured from an ammunition storage box into a hopper, the rounds then being oriented and fed to the main sprocket assembly. Alternative inlets include a tray for already-oriented rounds, and means for detecting nd filling any gaps which may occur in the stream of rounds.

The replenisher furthermore has a means for receiving rounds returned from the ammunition storage device and separating them into live rounds and empty cartridge casings. Near the end of the transport path along the replenisher, the protective cardboard shipping tubes normally provided on the projectile end of the rounds are stripped axially from the rounds, and collected.

Inasmuch as the replenisher of the invention is a modular component that mechanically and synchronously engages with the storage drum through a conveyor, the replenisher, conveyor and storage drum are all powered from a common drive at the replenisher or at the storage drum end. Protruding wrench-receiving shafts are provided, by which an operator can move rounds around the required circuit by rotating the shaft using a pneumatic wrench, hand crank or the like.

The invention improves the convenience and dependability of ammunition loading, without undue complexity or expense.

SUMMARY OF THE INVENTION

It is an object of the invention to provide a modular system including a replenisher for an ammunition storage drum, the replenisher being externally identical to the configuration of a gun magazine to be loaded by the ammunition storage system, whereby the ammunition storage means can be recharged conveniently by simply connecting it to a replenisher and operating the storage device as if the replenisher was a gun magazine to be reloaded.

It is another object of the invention to provide a replenishing means which requires a minimum amount of effort or attention on the part of human operators, to correct round orientation, fill gaps, correct jams, or sort rounds either entering or leaving the ammunition storage system.

It is a further object of the invention to provide a replenisher which is synchronously operable with other elements in a storage drum system.

It is another object of the invention to provide a replenisher which is durable and dependable yet inexpensive.

These and other objects are accomplished by a replenisher for an ammunition storage drum or the like having a housing with a main sprocket assembly rotatably disposed therein, the main sprocket assembly having receptacles for individual rounds of ammunition which are carried around a periphery of the main sprocket assembly. At least one inlet to the replenisher accepts separate (linkless) rounds and places them in the receptacles on the main sprocket assembly. The inlet preferably includes a hopper accepting rounds oriented in either of two opposite directions and an orienting means by which the rounds are selectively separated using at least one wire guide engaging the extractor flanges at the bases of the rounds, the guide being unable to engage the nose end of the rounds. The rounds thus separated are fed in two streams to a pair of converging helices, by which the now-oriented rounds are led again in single file, to a feed gear and sprocket assembly engaging the main sprocket assembly. At least one outlet device mates with the main sprocket assembly, the outlet having an external configuration dimensioned to receive an interface adapter which likewise mates with a device for utilizing the ammunition, for example an aircraft gun magazine. The ammunition storage drum interchangeably connects by means of a conveyor to the replenisher or the aircraft. The replenisher conveys live rounds to the ammunition storage drum and accepts spent rounds including unfired rounds and empty cartridge casings. Similarly, the storage drum connects to the aircraft and conveys live rounds to the aircraft while accepting spent rounds therefrom.

BRIEF DESCRIPTION OF THE DRAWINGS

There are shown in the drawings the embodiments that are presently preferred. It should be understood that the invention is not limited to the precise arrangements and instrumentalities shown in the drawings, and the invention is capable of embodiment in different variations, such as different groupings of the elements shown in the drawings by way of examples.

FIG. 1 is an elevation view showing an ammunition storage drum connected to the replenisher of the invention.

FIG. 2 is a partial elevation view showing the storage drum connected to the gun magazine of an aircraft.

FIG. 3 is a partially cut-away elevation view of the replenisher, as viewed from the left in FIG. 1.

FIG. 4 is a section view thereof, taken along lines 4—4 in FIG. 3.

FIG. 5 is a top plan view of the replenisher.

DETAILED DESCRIPTION OF THE PREFERRED EMBODIMENTS

Figure 6:
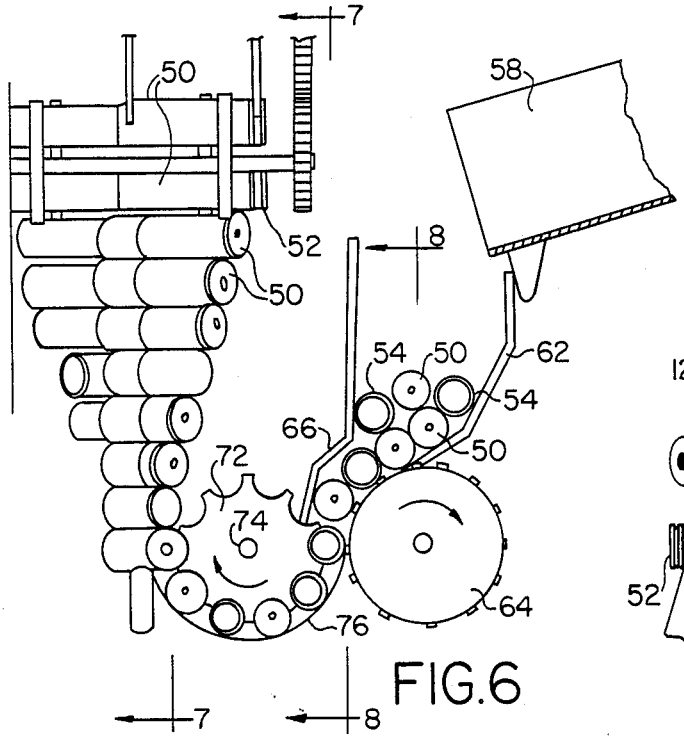
FIG. 6 is a detailed view of the round orienting mechanism of the replenisher, from an orientation similar to that of FIG. 3.

The replenisher 26 of the invention is a modular component in an ammunition storage and handling system including an ammunition storage drum 20, which is alternatively connectable by means of a flexible conveyor 22 to either the replenisher 26 of the invention, or to an aircraft 24, or like gun emplacement, as shown in FIGS. 1 and 2. The system stores and feeds rounds of ammunition, for example M56A3 20 mm ammunition to the magazine of a high rate of fire gun firing the linkless ammunition. The connections between the drum 20, replenisher 26 or aircraft 24 are made by means of interface units 28 at either end of conveyor 22. The interface units engage externally accessible gears on the storage drum 20 at one end of conveyor 22, and either the replenisher 26 or the aircraft 24 at the other end. An endless loop chain is disposed within conveyor 22, having links engaging with sprockets in each of the interface units 28, to thereby synchronously drive replenisher 26 and drum 20 or the magazine of aircraft 24 and drum 20, by means of power supplied at any of them.

Replenisher 26 is conveniently loadable and unloadable, and accepts rounds in any orientation, with or without protective tubes, etc. A minimum of human intervention is thus required for sorting, orienting or otherwise processing the rounds. The replenisher 26 can be wheeled about as required. A plurality of inlets and outlets can be provided, to receive and sort the rounds which are loaded initially or returned from the storage drum. The replenisher is quite compact and weighs only approximately 150 pounds.

The replenisher is shown in FIGS. 3–5, from various perspectives and with the outer covering and structural members shown cut-away to expose the internal working parts. FIGS. 6–15 illustrate the respective subassemblies. The replenisher is carried on a frame of welded tubular frame elements 32, with a sheet metal cover 34 disposed thereon. The frame elements 32 define attachment points and mounting surfaces for the inlet and outlet means leading to and from a main gear and sprocket assembly 40, which has a gear wheel 44 and sprocket mechanism 46 fixed to one another on a common rotatable shaft 42. The rounds are carried from the inlets, around the sprocket 46 of main gear/sprocket assembly 40, toward the connection with interface unit 28 of conveyor 22. Rounds move away on the conveyor and also return, moving again through interface unit 28 and then to an outlet means further around main gear/sprocket 40. The replenisher assembly frame is carried on swivel casters 36, to allow free movement in any direction. One or more handles 38 can be attached to the replenisher frame to assist in moving it about.

In FIG. 3, the sheet metal cover 34 is shown partly broken away and in the remaining views the cover is shown removed. Sheet metal covers can be provided around the outside, and are removable, for example by means of screws. Openings are provided for receiving a standard ammunition box 58, shown in FIG. 3, and for the inlet and outlet trays shown in FIGS. 4 and 5. These trays (in particular the feed tray 142 and the unload tray 182), can be pivoted outwardly into the deployed condition as shown, or inwardly for stowing. The traps are hinged around pivots disposed at or within the volume encompassed by the covers 34, such that the replenisher can be stored compactly.

The replenisher of the invention does not have an internal conveyor belt and/or chute, which might have a tendency to jam. Instead, the rounds are positively engaged and moved onto and off of the main sprocket assembly 40, by the means shown. Each of the movable parts comprised in the inlet and outlet means is geared to operation of the main sprocket assembly 40, more particularly to gear 44 thereof. A wrench-receiving fitting 138, shown in FIG. 3, allows the operator to employ a pneumatic wrench or hand crank for turning drive gear 132 (shown in FIG. 4), thereby rotating main gear 44, whereby the operation of the entire device is driven and synchronized.

As shown in FIGS. 3 and 6, the ammunition box 58 is simply turned up to pour unconnected rounds into a hopper 62. Ammunition box 58 and its contents are standard elements, for example an M548 ammunition box, storing twenty millimeter M56A3 rounds. The rounds can be in any orientation and may or may not include standard packing tubes on the nose ends. The rounds, however, become oriented parallel when resting on one another and therefore assume either of two opposite orientations parallel to the axis of main sprocket assembly 40, when poured into hopper 62 as shown.

The hopper 62 narrows downwardly, as best seen in FIG. 6. The funnel-like narrowing arrangement places the rounds in single file order, leading into a sprocket 72, which is rotatable on shaft 74. In order to prevent jamming of the rounds 50 proceeding down hopper 62 toward sprocket 72, a roller 64 frictionally engages and agitates the rounds, leading them into a single file adjacent constriction 66 at the downstream end of the hopper in feed direction, namely, from the inlet toward main gear/sprocket assembly 40, and then around assembly 40 in a counterclockwise direction. Roller 64 rotates opposite the feed direction. Roller 64 thereby rolls the rounds against one another, preventing jamming. Roller 64 can have shallow teeth as shown, and/or can include a frictional surface for rolling and agitating the rounds, preventing jamming.

Figure 8:
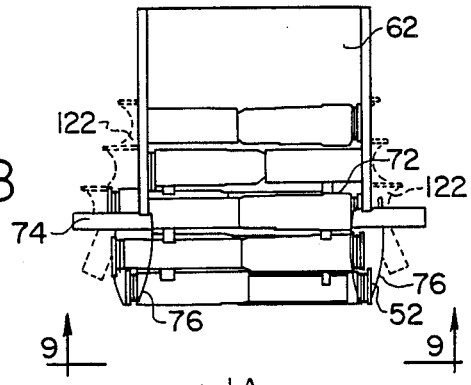
FIG. 8 is a partial section view taken along lines 8—8 in FIG. 6.
Figure 9:
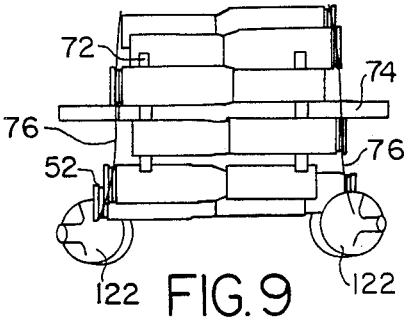
FIG. 9 is a partial section view taken along lines 9—9 in FIG. 8.

Hopper 62 at its outlet is just as wide as the rounds are long, which can be seen in FIG. 8. FIG. 8 also shows that the rounds are randomly oriented in opposite directions, and need not be in exactly alternating order. The rounds are picked up by starwheel 72 at the outlet of hopper 62, at that point the rounds being aligned parallel to one another and to the axes of rotation of sprocket 72 and roller 64.

The rounds are retained against falling out of the starwheel 72 by guide rails 76, which can be formed flanges or, preferably, simple wire guides. The wire guides are positioned relative to the edges of hopper 62 as shown in FIG. 8, to engage each of the rounds by the groove defined between the extractor flange 52 and the body of the cartridge casing. The extractor flange groove, which is provided at the base of every round, is used according to the invention as a means for sorting the rounds which are oriented in one direction or the other. The wire guides 76 diverge axially relative to the axis of sprocket 72, whereby all the rounds which when received are oriented to face away from a given wire guide are engaged and axially moved outwardly by that wire guide. The wire guide on one or both sides engages in the extractor flange groove of the rounds, but cannot engage the smooth rounded nose of the rounds oriented in the opposite direction. The divergence of wire guide 76 around the circumference of sprocket 72 is such that at the exit from starwheel 72, the projectile ends of the rounds facing in one direction are axially spaced from the extractor flange ends of the rounds facing in the other direction. Downstream of the wire guide 76 and starwheel 72, the rounds, now separated by action of the wire guides, are picked up by converging helices 122. Due to their separation, all the rounds facing in one direction are picked up by one helix and all the rounds facing in the other direction are picked up by the other helix. The helices then converge, returning the rounds to a single file, but all the round now being oriented in the same direction.

Helices 122 are commonly driven with the other moving parts, from the main gear/sprocket assembly 40. Preferably, a roller chain runs between a sprocket on a common shaft with the wrench-receiving fitting 138, and the chain driving sprockets 126, shown in FIG. 4. The helices 122 are rotated in opposite directions for moving the rounds back into single file as shown in FIG. 4, the left helix having a right hand thread, the right helix having a left hand thread. Both helices rotate outwardly such that each round is pushed upwardly as shown in FIGS. 4, 6 and 7.

Figure 7:
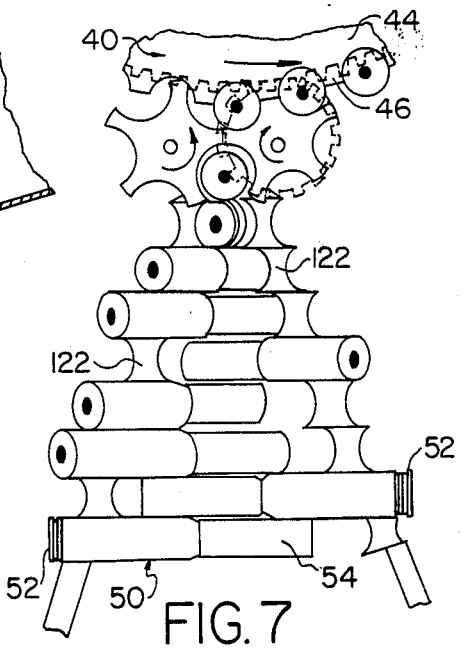
FIG. 7 is a partial section view taken along lines 7—7 in FIG. 6.

The rounds as axially separated by wire guides 76 rested on one of the two helices 122 when initially placed on their respective helix, at the lower end of the helices as shown in FIG. 7. Due to the spacing of the helices being greater than the length of the rounds, the left helix and right helix can engage only the rounds pointed towards their respective counterpart, the rounds now being segregated by their orientation. As the helices turn, the rounds are carried upwardly while remaining parallel. The helices converge over a short distance, being aligned for example at 30°. The rounds proceed upwardly as they come together again into the stream, now all oriented in the same direction.

At the confluence of the two helices, two five-slotted sprocket assemblies are arranged on either side of the rounds to capture each round, the sprocket assemblies including a starwheel 134 and gear 132 fixed together on a common rotatable shaft, the gear 132 being engaged and rotated synchronously with the teeth of gear 44 of main sprocket assembly 40 and the sprocket pockets rotating therewith. Main sprocket assembly 40 has a sprocket 46 with pockets for receiving the rounds from the starwheels 134, 134, whereby the rounds are picked up and carried around the circumference of main gear/sprocket assembly 40, in a counterclockwise direction as shown.

Figure 14:
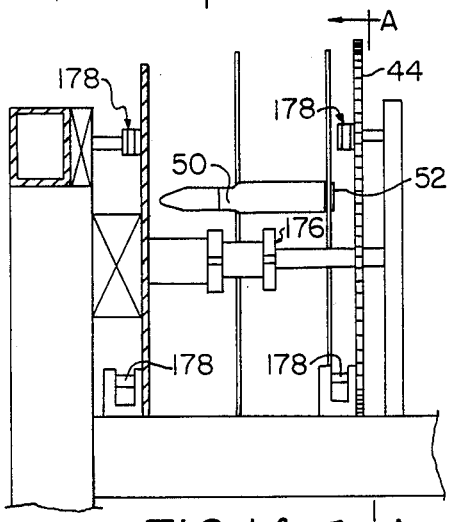
FIG. 14 is a partial elevation view from the left in FIG. 4 showing the replenisher with the interface to the conveyor removed.
Figure 15:
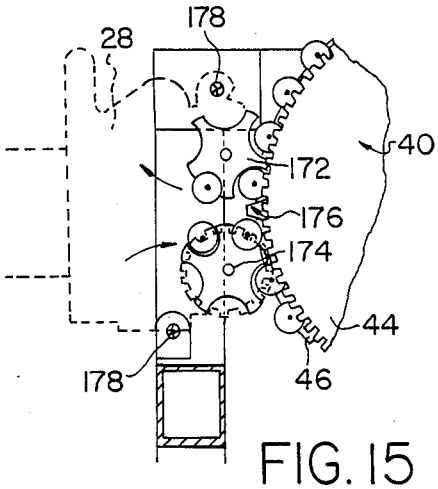
FIG. 15 is a partial elevation view of the interface area, corresponding to FIG. 4.
Figure 10A:
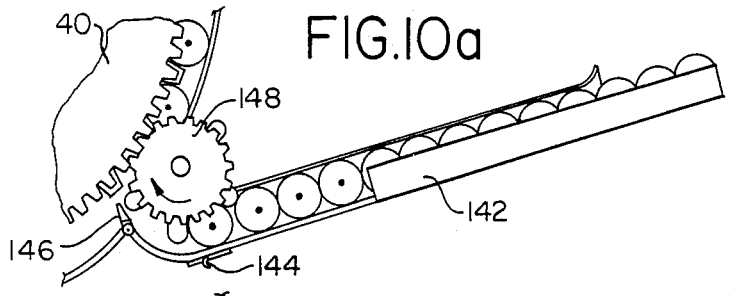
FIGS. 10*a* and 10*b* are cut-away elevation views showing an alternative inlet means to the main sprocket assembly, in two different orientations.
Figure 10B:
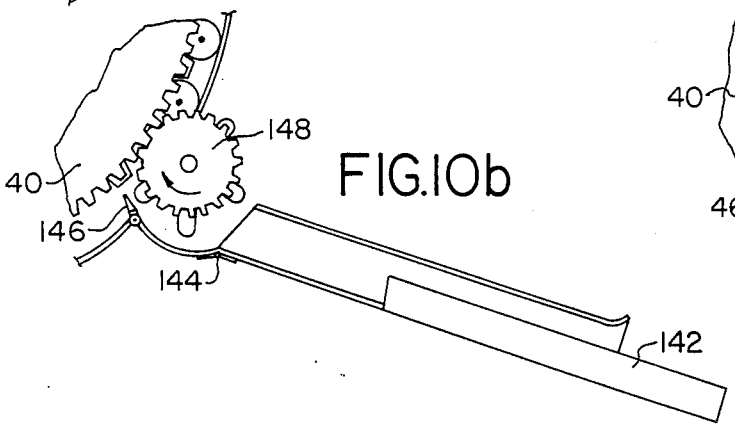

The sprocket 46 of main gear assembly 40 in a preferred embodiment has a 13.75 inch pitch diameter and 25 round-receiving pockets or slots. The corresponding drive gear 132 and sprocket 134 have a 2.75 inch pitch diameter, with 5 slots. The rounds remain disposed in the sprocket slots of main gear assembly 40 as they are carried around about 270° of the circumferences of the gear/sprocket assembly 40, i.e., until they reach the interface unit 28, as shown in FIGS. 14 and 15.

As a result of the round orienting function of the replenisher, one need only dump a box of ammunition into the hopper and the replenisher will do all the sorting, handling and the like required to provide a continuous serial stream of rounds in the required condition and orientation. The replenisher preferably operates at the moderate rate of 100 rounds per minute, such that the incidence of jamming is minimal and wear is not a major problem.

Rounds fed by the orienting mechanism are held in place in their pockets, against sprocket 46 of main gear/sprocket assembly 40, by guides, for example wire guides, which extend around the circumference of main gear assembly 40. The guides have openings where required for ingress and egress of rounds via inlet and outlet means. Preferably, alternative inlet means in addition to the round orienting means are provided in the form of a feed tray and a gap filler, shown respectively in FIGS. 10*a*, 10*b*, 11*a* and 11*b*. These alternative feed trays as shown accept rounds that are already oriented, however, it is also possible to use a similar orienting arrangement as that discussed hereinabove, leading into the feed tray.

The feed tray can be used to supply rounds to gear/sprocket assembly 40 whenever the orienting mechanism is not used. Alternatively, the orienting mechanism can be arranged to feed a predetermined number of rounds, then to leave a space for a different type of round to be inserted at the feed tray, for example a tracer round or the like. In that case, the initial sprocket can be provided with a closed pocket, thereby leaving a space in the serial stream of rounds, to be filled by a downstream inlet means, for example loaded with tracer rounds.

Preferably, feed tray 142 is mounted on a hinge 144 such that tray 142 can be rotated in a compact fashion between a deployed position and a stowed one. A toggle 146 is provided at the inlet to the gear/sprocket assembly 148 by which feed tray 142 connects to main gear/sprocket assembly 40. The gear/sprocket assembly 148 associated with the feed tray is provided with a five slot starwheel and 2.75 inch pitch diameter spur gear, similar to gear 132 and sprocket 134. Each of the spur gears mates with the main gear 44 of main gear/sprocket assembly 40, such that the rounds being moved from feed tray 142 or the like onto the slots in the sprocket 46 of main gear/sprocket assembly 40, are correctly aligned, the rounds being placed in the sprocket slots.

The feed tray 142 preferably can be positively locked in either its upper operative position or lower stowed position by means of a quick-release pin (not shown) fixing the tray 142 to a frame element 32. When rounds are fed through the feed tray, flap 146 is pivoted into the position shown, guiding rounds from gear/sprocket assembly 148 onto main gear/sprocket assembly 40, rotating counterclockwise (upwardly) in FIG. 10*a* and 10*b*. When a round arrives through the orientor, however, the round moves flap 146 counterclockwise, allowing the rounds on main gear/sprocket assembly 40 to pass by, and also retaining the rounds against falling off of main gear/sprocket assembly 40 and into the opening defined by the feed tray. Guide means, for example guide wires, otherwise extend around the full periphery of the main gear/sprocket assembly 40, retaining the rounds in the pockets of sprocket 46, except at those points where feed tray 142 or gap filler 152 require access and a gap if left in the guide means.

The gap filling apparatus is preferably placed immediately downstream of feed tray 142 in the feeding direction. The gap filler has a small tray 152, with at least a few rounds (e.g. 3 rounds), and a feeding sprocket/starwheel assembly 158, similar to that of the feed tray. Unlike the feed tray, rounds in gap filler tray 152 are only advanced when a gap is detected by means of a spring biased feeler 154 and cam gate 156.

Figure 11A:
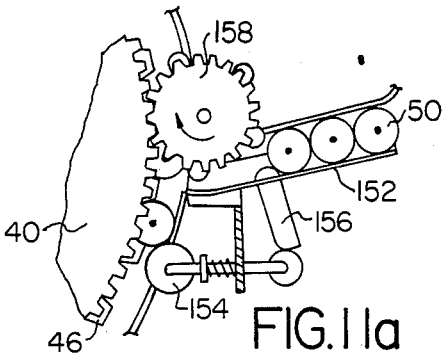
FIGS. 11*a* and 11*b* are cut-away elevation views showing a further inlet in the form of a gap filling device, shown in two alternate positions.
Figure 11B:
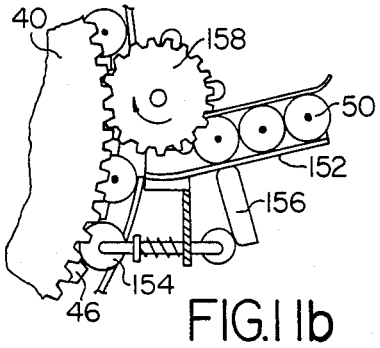

The cam gate 156 keeps the rounds 50 in gap filler tray 152 at a space from the sprocket of gear/sprocket assembly 158, which is engaged to main gear/sprocket 40. Accordingly, although gear/sprocket assembly 158 rotates continuously and synchronously with rotation of main gear/sprocket assembly 40, rounds 50 are only advanced when a passing pocket in sprocket 46 of main gear/sprocket assembly 40 is found to be empty as the next opening in the sprocket portion of gear/sprocket assembly 158 comes into position to engage a next round. This situation is shown in FIG. 11*b*. When a gap appears in the main sprocket assembly, the shaft carrying feeler 154 moves forward due to its spring biased mounting, into the space at the next sprocket opening which normally would carry a round. Advance of feeler 154 allows the cam gate 156 to disengage from the queued rounds in the gap filler tray, which then advance in the same manner as rounds in feed tray 142. Preferably, the gap filler can be manually overridden by locking feeler 154 back from sprocket 46 using a retaining clasp (not shown).

Figure 13:
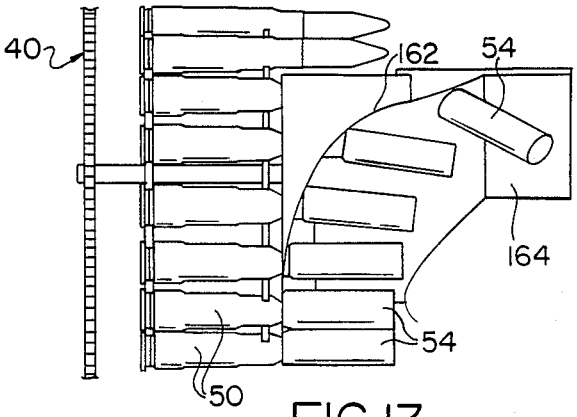
FIG. 13 is a partial plan view of the replenisher, illustrating the tube stripper.

Downstream of the feed tray 142 and gap filler 152, each round passes through a tube stripper, shown in FIGS. 5 and 13. As the rounds pass on their circumferential path around main gear/sprocket assembly 40, an inclined contact edge 162 of the tube stripper passes under one or both edges of protective tubes 54. The rounds continue to advance around gear/sprocket assembly 40, as the tubes slide along edge 162. Edge 162 is inclined axially away from the rounds, whereby tubes 54 are stripped off and then dropped into stripper tray 164. The inclined edge 162 can be provided on one side, or preferably on both sides, in the latter case defining a fork that catches the base of the tube on both sides, right above the shoulder of the round. As the fork pulls the tubes off, the tubes can be collected from tray 164 in an empty ammunition box placed by the side of the replenisher, on the ground. Tube stripper tray 164, like tray 142, is arranged to be foldable inwardly for storage in a compact manner, preferably within the frame structure defined by tubular frame elements 32. Rounds without tubes pass through the tube stripper without any effect, the rounds fitting easily between the inclined edges 162 of the tube stripping fork.

Preferably, means are provided downstream of the tube stripper for counting every round passing by. A non-resetable eight-digit counter can be mounted on top of the frame and provided with means for incrementing the count upon passage of each round. Preferably, a mechanical-type counter having a movable contact tab increments the count every time a round displaces the movable tab.

FIGS. 14 and 15 illustrate the connection between the interface unit 28 and the replenisher. As the rounds are moving around gear/sprocket assembly 40, shown in FIG. 15, they encounter the upper starwheel/gear assembly 172, which is attached in interface unit 28 to the conveyor. The conveyor carries rounds in both directions to and from the ammunition storage device. An abutment or diverter 176 is provided to guide the rounds around the sprocket in gear/sprocket assembly 172, whereupon the rounds pass through interface unit 28 to the external conveyor leading to the ammunition storage drum. Guide/diverter 176, which is also shown in FIG. 14, lifts the rounds out of the pockets of sprocket 46, and also guides returning rounds back into the pockets. Diverter 176 is mounted in the preferred embodiment on the replenisher rather than in the interface unit 28. It is also possible to mount a diverter in the interface unit 28, whereupon with removal of the interface unit, rounds will simply pass around main gear/-sprocket assembly 40 from inlet to outlet, being thereby oriented, stripped and/or sorted from empty cartridge casings.

As shown in FIG. 14, interface unit 28 is preferably attachable to the replenisher by means of attachment pins 178, provided at the leading and trailing edges of interface unit 28 along the conveying direction. Pins 178 simply allow an easy-release attachment point for interface unit 28, whereby the gear/sprocket assemblies 172, 174 can be brought up to mesh with gear 44 of the main gear/sprocket assembly 40, and whereby the rounds pass smoothly from sprocket to sprocket with guidance from diverter 176.

Figure 12A:
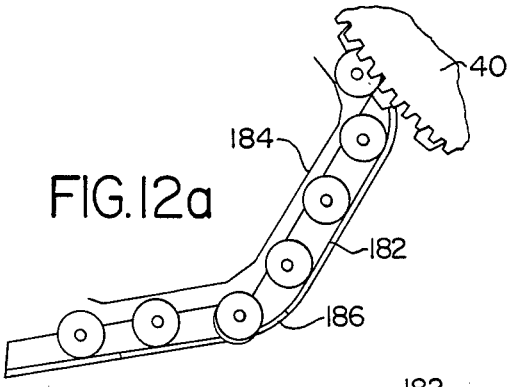
FIGS. 12*a* and 12*b* are cut-away elevation and plan views, respectively, of an outlet means for sorting live rounds from empty cartridge casings.
Figure 12B:
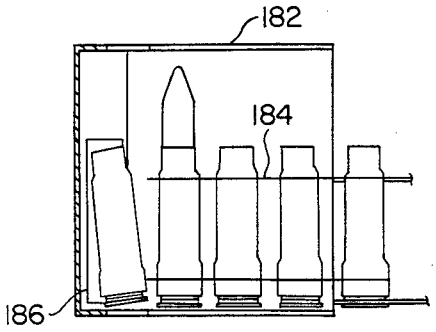

Following interface unit 28 along the counterclockwise rotation of main sprocket/gear wheel 40, the rounds returning through interface unit 28 proceed to the unload tray 182, shown in FIGS. 12*a* and 12*b*. An outer guide means 184, for example a wire guide, is disposed over the rounds which roll off of main gear/-sprocket assembly 40 into unload tray 182. Along the path of the rolling rounds along tray 182 is disposed a sorting opening 186, dimensioned large enough to admit empty cartridge casings, but not large enough to allow a round still including its projectile end to fall through. Accordingly, the unload tray 182 sorts rounds, dropping the empty cartridge casings and allowing unfired rounds to be collected at the end of the tray 182. Preferably, ammunition boxes are placed under opening 186 and at the end of the tray such that these rounds can be collected. The outlet tray assembly, like the inlet tray assembly, is also hinged so that it can be folded down inside the frame for compact storage. When deployed in its operative position as shown in FIG. 12*a*, the tray can be locked in position by a suitable quick-release pin (not shown), passing through the tray into one of the frame members 32 of the replenishing device.

The invention as disclosed herein is an apparatus for feeding ammunition along a feed path, including a housing, a main sprocket rotatably mounted in the housing, the main sprocket having receptacles for individual rounds of ammunition disposed around a periphery thereof, at least one inlet means adapted to accept separate (linkless) rounds and to place said rounds in the receptacle of the main sprocket, and, at least one outlet means mating with the main sprocket, the outlet means having an external configuration dimensioned to receive an interface adapter carrying rounds from the main sprocket, the external configuration being substantially the same as an external configuration of a device for utilizing the ammunition, the rounds progressing along the feed path in a feed direction from the at least one inlet means to the at least one outlet means. The device for utilizing the ammunition can be, for example, an aircraft gun magazine or a fixed gun emplacement. The present apparatus is removably attachable to an interface adapter leading to a bi-directional conveyor connected to an ammunition storage means, whereby the ammunition storage means is alternatively attachable to the apparatus of the invention for refilling the ammunition storage means, or to the device for utilizing the ammunition, i.e., the gun magazine.

The at least one inlet means includes a round orientor having a hopper for receiving the rounds in random orientations, the hopper having a wide upper opening and the hopper narrowing to an elongated slot at a bottom thereof, the slot being dimensioned to complement the rounds, the rounds being moved by gravity toward the slot and oriented by the slot in either of two opposite directions along a longitudinal extension of the slot. The hopper has an inclined bottom wall leading to the slot and a roller is disposed adjacent the inclined bottom, the roller being driven backwards with respect to the feed direction of the rounds, whereby jamming at the slot is minimized. The roller can be provided with shallow teeth and/or a frictional surface to agitate the rounds. Means are provided for separating the rounds as a function of their orientation, including a starwheel sprocket receiving and carrying individual randomly-oriented rounds circumferentially around an axis and at least two guide rails extending around a portion of circumference of the starwheel sprocket, the guide rails engaging extractor flanges of the rounds and the guide rails diverging axially while progressing around said portion of circumference, whereby the rounds are separated into two streams of identically-oriented rounds. The guide rails are preferably wire guides extending about 180° around the starwheel sprocket. The separated rounds are fed to two helical feed screws disposed adjacent the guide rails and receiving the separated rounds, the feed screws having an upstream end at which the feed screws are spaced by more than a length of the rounds, whereby the rounds separated as a function of orientation are carried together with all other rounds of the same orientation on one of said two feed screws. A support structure can be disposed adjacent the helical feed screws, having an upstream end supporting the rounds adjacent a plane a downstream end at which the rounds are spaced from the plane, the separated rounds being carried by the feed screws at one end of the rounds and the support structure and feed screws guiding the rounds through a 90° angular displacement. The support structure can be a continuation of the guide rails.

The helical feed screws preferably converge to feed the rounds in oriented single file to a sprocket assembly at a downstream end of the feed screws, the feed screws being spaced at the downstream end by substantially the width of a round, whereby all the rounds are oriented the same after passing through the helical feed screws.

The helical feed screws feed the rounds to a sprocket assembly at the downstream end, the sprocket assembly being geared to the main sprocket and passing rounds from the feed screws to the main sprocket. The helical feed screws, starwheel sprocket and other means are preferably all geared through to the main sprocket assembly, the latter having a gear engageable at desired points around the periphery.

The inlet means preferably also includes an inlet feed tray and a feeding sprocket, the feeding sprocket being geared to the main sprocket and having receptacles for engaging a foremost round in the feed tray and moving said foremost round to the main sprocket, the feed tray supporting the rounds parallel to one another and perpendicular to the feeding direction. The feed tray is attached to the apparatus by a hinge, whereby the feed tray can be deployed and stowed by displacement in one direction or the other around the hinge, the device further comprising means for locking the feed tray in place as deployed and as stowed.

A flap assembly is disposed at a downstream end of the feed tray in a path of the rounds moving on the main sprocket, at least one of the feed tray and feeding sprocket being blocked by the flap assembly in a blocking position, the flap assembly being moved to the blocking position by rounds moving in the path.

The inlet means preferably also includes a gap filler having a gap filler feed tray and a gap filler feeding sprocket receiving rounds from the gap filler feed tray, the gap filler feeding sprocket being geared to the main sprocket, the gap filler further comprising an automatic gate having means blocking movement of rounds through at least one of the gap filler feed tray and the gap filler feeding sprocket, the gate including a member deflected upon passing of rounds moving on the main sprocket, the contact member being connected to disable said means blocking movement of rounds when a next receptacle in the main sprocket is empty, whereupon the next round is fed from the gap filler feeding sprocket to the main sprocket. The contact member can be spring biased toward the main sprocket.

An outlet means downstream of the interface adapter on the main sprocket assembly receives the rounds which are returned to the main sprocket assembly from the interface adapter, the outlet means having an unloading tray downstream of the interface adapter for removing rounds from the main sprocket and defining an end of the feed path. The unloading tray has a dropout gap dimensioned to allow empty shell casings to fall through the unloading tray while retaining unfired rounds.

A tube stripper is disposed along the feed path upstream of the interface adapter, the tube stripper having a stripper means, for example an inclined fork, engaging packing tubes on ends of the rounds, the stripper means diverging transversely of the feed path and axially of the rounds, whereby the packing tubes are stripped off the rounds during feeding.

A number of variations will now be apparent to persons skilled in the art made aware of this disclosure. Reference should be made to the appended claims rather than the foregoing specification as indicating the true scope of the subject invention.

We claim:

1. An apparatus for feeding ammunition along a feed path, comprising:

a housing;

means defining a main path for the ammunition, mounted in the housing and having receptacles for individual rounds of ammunition to be moved along the main path;

at least one inlet means adapted to accept separate rounds and to place said rounds in the receptacles along the main path, the inlet means including an orientor for receiving and orienting the rounds, the orientor having an inlet opening and narrowing to an elongated outlet dimensioned to complement the rounds, the rounds being moved toward the outlet and oriented by the outlet in one of two opposite directions along a horizontal extension of the outlet, the rounds being fed in registry through the outlet; and, at least one outlet means mating with the means defining the main path, the outlet means having an external configuration dimensioned to receive an interface adapter carrying rounds from the main path, the external configuration being substantially the same as an external configuration of a device for utilizing the ammunition, the rounds progressing along the feed path in a feed direction from the at least one inlet means to the at least one outlet means.

2. The apparatus of claim 1, wherein the device for utilizing the ammunition is one of an aircraft and a gun emplacement, and further comprising means on the housing for removably mounting the interface adapter, the interface adapter being attached to a bi-directional conveyor connected to an ammunition storage means, whereby the ammunition storage means is attachable alternatively to said apparatus for feeding ammunition, for servicing the ammunition storage means, and to the device for utilizing the ammunition.

3. The apparatus of claim 1, further comprising a tube stripper disposed along the feed path, the tube stripper having a stripper means engaging packing tubes on an end of the rounds opposite an extractor flange end, the stripper means diverging transversely of the feed path and axially of the rounds, whereby the packing tubes are stripped off the rounds.

4. The apparatus of claim 1, wherein the outlet means also receives rounds back from the interface adapter and moves the rounds to the main path, the outlet means including an unloading tray downstream of the interface adapter, the unloading tray removing rounds from the main path and defining an end of the feed path.

5. The apparatus of claim 4, wherein the unloading tray has a dropout gap dimensioned to allow empty shell casings to fall out of the unloading tray while retaining unfired rounds.

6. The apparatus of claim 1, wherein said inlet means includes an inlet feed means having a feed tray and a feeding sprocket, the feeding sprocket being geared to the means defining the main path and having receptacles for engaging a foremost round in the feed tray and moving said foremost round to the means defining the main path, the feed tray supporting the rounds parallel to one another and perpendicular to the feeding direction.

7. The apparatus of claim 6, further comprising a hinge attaching the feed tray to the apparatus, whereby the feed tray can be deployed and stowed by the displacement around the hinge, and further comprising means locking the feed as deployed and as stowed.

8. The apparatus of claim 6, further comprising a flap assembly disposed at a downstream end of the feed tray and in a path of rounds moving on the main path, at least one of the feed tray and feeding sprocket being blocked by the flap assembly in a blocking position, the flap assembly being moved to the blocking position by rounds in the path.

9. An apparatus for feeding ammunition along a feed path, comprising:

a housing;

a main sprocket rotatably mounted in the housing, the main sprocket having receptacles for individual rounds of ammunition disposed around a periphery thereof;

at least one inlet means adapted to accept separate rounds and to place said rounds in the receptacles of the main sprocket, said inlet means including a round orientor having a hopper for receiving said rounds, the hopper having a wide upper opening and narrowing to an elongated slot at a bottom of the hopper, dimensioned to complement the rounds, the rounds being moved by gravity toward the slot and oriented by the slot in one of two opposite directions along a horizontal extension of the slot, the rounds being fed in registry through the slot; and, at least one outlet means mating with the sprocket, the outlet means having an external configuration dimensioned to receive an interface adapter carrying rounds from the main sprocket, the external configuration being substantially the same as an external of a device for utilizing the ammunition, the rounds progressing along the feed path in a feed direction from the at least one inlet means to the at least one outlet means.

10. The apparatus of claim 9, wherein the hopper has an inclined bottom wall leading to the slot and further comprising a roller adjacent the inclined bottom wall, the roller being driven to roll rounds backwards adjacent the slot, whereby jams at the slot are minimized.

11. An apparatus for orienting and feeding ammunition, comprising:

means defining a feed path for successive individual ones of the rounds, and an inlet to the feed path, the inlet narrowing to an opening leading to the feed path such that loose rounds passing through the inlet to the feed path are oriented in one of two opposite directions;

means for separating individual rounds passing the opening as a function of orientation of the rounds in said opposite directions, including a starwheel sprocket receiving and carrying the individual rounds around an axis of the starwheel sprocket, the rounds being positioned substantially parallel to the axis of the starwheel sprocket, and at least two guide rails extending around a portion of a circumference of the starwheel sprocket, the guide rails engaging extractor flanges of the rounds, the guide rails diverging from one another axially progressing around said portion of a circumference, whereby the rounds in the two opposite directions are caused to diverge as a function of orientation; and, two helical feed screws disposed adjacent the guide rails, each of the helical feed screws receiving said rounds from one of the guide rails, the feed screws turning the rounds and the feed screws converging leading to the feed path, whereby the rounds are combined into a succession of rounds oriented in a same direction.

12. The apparatus of claim 11, wherein the guide rails are wire guides extending about 180° around the starwheel sprocket.

13. The apparatus of claim 11, wherein the feed screws are spaced from one another adjacent the guide rails by more than a length of the rounds, whereby each of the rounds separated as a function of orientation are carried on one of said feed screws together with all other rounds of the same orientation.

14. The apparatus of claim 13, wherein the helical feed screws are disposed substantially in a plane and further comprising a support structure for at least a part of the rounds, having an upstream end supporting the rounds adjacent said plane and a downstream end at which the rounds are spaced away from said plane, the separated rounds being carried by the feed screws at one end of the rounds and the support structure and the feed screws guiding the rounds through a 90° angular displacement.

15. The apparatus of claim 14, wherein the support structure is a continuation of the guide rails.

16. The apparatus of claim 14, wherein the helical feed screws converge to a downstream end at which the feed screws are spaced by a width of a round, all the rounds being oriented the same at said downstream end.

17. The apparatus of claim 16, further comprising a sprocket assembly at the downstream end of the helical feed screws, the sprocket assembly being geared to the main sprocket and passing rounds from the feed screws to the main sprocket.

18. The apparatus of claim 17, wherein the feed screws and the starwheel sprocket are also geared for driving through the main sprocket.

19. An apparatus for feeding ammunition along a feed path, comprising:

a housing;

means defining a main path for the ammunition, mounted in the housing and having receptacles for individual rounds of ammunition to be moved along the main path;

at least one inlet means adapted to accept separate rounds and to place said rounds in the receptacles along the main path, the inlet means including an orientor for receiving and orienting the rounds, the orientor having an inlet opening and narrowing to an elongated outlet dimensioned to complement the rounds, the rounds being moved toward the outlet and oriented by the outlet in one of two opposite directions along a horizontal extension of the outlet, the rounds being fed in registry through the outlet;

at least one outlet means mating with the means defining the main path, the outlet means having an external configuration dimensioned to receive an interface adapter carrying rounds from the main path, the external configuration being substantially the same as an external configuration of a device for utilizing the ammunition, the rounds progressing along the feed path in a feed direction from the at least one inlet means to the at least one outlet means; and, a gap filler associated with the inlet means, the gap filler having a gap filler feed tray and a gap filler feeding sprocket receiving rounds from the gap filler feed tray, the gap filler feed sprocket being geared to the means defining the main path, the gap filler further comprising an automatic gate having means blocking movement of rounds through at least one of the gap filler feed tray and the gap filler feeding sprocket, the gate including a contact member deflected upon passing of rounds moving on the main path, the contact member being connected to disable said means blocking movement of rounds when a next receptacle in the main path is empty, whereupon the next round is fed from the gap filler feeding sprocket to the main path.

20. The apparatus of claim 19, wherein the contact member is spring biased toward the main path.

* * * * *